United States Patent [19]

Kunert et al.

[11] 3,945,912

[45] Mar. 23, 1976

[54] UREA DEWAXING OF LOW N-PARAFFIN CONTENT OILS

[75] Inventors: Maximilian Kunert, Neu-Wulmstorf; Hans-Georg Wegner, Tangendorf, both of Germany

[73] Assignee: Deutsche Texaco Aktiengesellschaft, Hamburg, Germany

[22] Filed: June 28, 1974

[21] Appl. No.: 484,002

[30] Foreign Application Priority Data

June 30, 1973 Germany ..... 2333470

[52] U.S. Cl. ..... 208/25; 260/96.5 C

[51] Int. Cl.[2] ..... C10G 43/04

[58] Field of Search ..... 208/25; 260/96.5 C

[56] References Cited

UNITED STATES PATENTS

| | | | |
|---|---|---|---|
| 2,560,193 | 7/1951 | Shoemaker | 260/96.5 C |
| 2,731,391 | 1/1956 | Salzmann | 260/96.5 C |
| 3,600,297 | 8/1971 | Franz et al. | 208/25 |
| 3,847,791 | 11/1974 | Kunert et al. | 208/25 |

*Primary Examiner*—Herbert Levine

*Attorney, Agent, or Firm*—T. H. Whaley; C. G. Ries; William E. McNulty

[57] ABSTRACT

Mineral oils containing small amounts (less than 2 weight percent) of normal paraffins may be urea dewaxed to produce refrigerator oils having Freon cloud or flock points of at least minus 55°C. by utilizing large excesses of the amount of crystalline urea theoretically required for complete conversion of the n-paraffins into solid adduct and conducting the adduct formation under conditions of vigorous agitation.

8 Claims, No Drawings

UREA DEWAXING OF LOW N-PARAFFIN CONTENT OILS

BACKGROUND OF THE INVENTION

The invention relates to the urea-dewaxing of mineral oils containing very small amounts of n-paraffins. More particularly, the invention relates to the production of refrigerator oils from such low paraffin content mineral oils.

It is known to dewax hydrocarbon mixtures or mineral oil distillates by reacting them with urea to form solid inclusion compounds or adducts of the n-paraffins and separating these adducts from the dewaxed mineral oil. This process is called urea dewaxing and has been used in different embodiments for the large-scale refining of mineral oil. Usually in this process, the mineral oil distillate charge is diluted with an organic solvent or mixture of solvents in order to reduce the viscosity of the reaction mixture, to improve its pumping and mixing properties, and to increase the degree of separation of the adduct and the dewaxing selectivity. In most cases, the same solvent, or solvent mixture, is used for washing the separated adducts and, if desired, for extracting the n-paraffins from the adduct. The solvent, or solvent mixture, should not form adducts with urea under the reaction conditions being employed. Conventional solvents include lower aliphatic and aromatic hydrocarbons, chlorinated hydrocarbons such as, dichloromethane, and the like.

Usually, the urea is dissolved in water or methanol, the solution having been saturated at a temperature above the predetermined reaction or adduct-forming temperature. The amount of urea required for adduct formation is from 3.5 to 4 parts by weight per part by weight of n-paraffin to be separated from the mineral oil. It has also been proposed to use urea in crystalline form, preferably finely divided. In this case the formation of adduct progresses at a very slow rate, therefore usually minor amounts of so-called activators such as water, methanol, ketones, and other urea-dissolving agent are added.

It is also known to initiate or accelerate the adduct-forming process by introducing a so-called "seed adduct". Another known method of enhancing the formation of adduct is by vigorously mixing the reaction mixture. However, vigorous mixing of such mixtures, especially aqueous ones, frequently tends to form emulsions which can be broken only with great difficulty.

With the known urea dewaxing processes it may be difficult to separate the adducts from the solution of the dewaxed mineral oil since the adduct often is in the form of a dust-like powder or a slimy-sticky mass which does not lend itself to filtration. Powder-like adducts may be separated by centrifuging inasmuch as there is a sufficient difference in gravity between them and the solution. There have also been attempts to remove the adduct, especially slimy adduct, from the solution by allowing it to settle. However, this remedial measure would require large volume settlers and would be so time-consuming that it could hardly be useful in a continuous commercial operation.

The above described difficulties of the prior dewaxing processes become more acute when the mineral oil distillate charge comprises only minor amounts or just traces of n-paraffins.

It is the object of this invention to improve the urea dewaxing process so that very small amounts of n-paraffins contained in mineral oil distillate and similar hydrocarbon mixtures may be removed therefrom in a simple relatively rapid manner, and that the removal is practically complete and is preferably performed in a continuous operation. Another object is to produce a lubricating oil for refrigerating machines from a naphthenic mineral oil distillate.

SUMMARY OF THE INVENTION

Refined mineral oils having Freon cloud or flock points of at least minus 55°C. may be produced from mineral oil distillates, particularly naphthenic mineral oil distillates, containing small amounts (less than 2 weight percent of normal paraffins) by a urea dewaxing process. In this process crystalline urea in large excess of the stoichiometric amount required to form the n-paraffin-urea adduct, is added to a mixture of the distillate and an organic solvent, the resultant mixture is vigorously mixed to effect adduct formation and the dewaxed mineral having the requisite cloud or flock point is recovered.

DESCRIPTION OF THE PREFERRED EMBODIMENTS

This invention contemplates the production of refrigerator oils by urea dewaxing mineral oil distillates containing small amounts, i.e., less than 2 weight percent, of normal paraffins.

This urea dewaxing process comprises:

a. diluting a mineral oil containing less than 2 weight percent n-paraffins with an organic solvent, said solvent being one which does not form an adduct with urea, in which urea is substantially insoluble and which has a density substantially below that of n-paraffin-urea adduct, b. combining the mineral oil solution with solid urea, the amount of said urea being a multiple of the amount required for the complete conversion of the n-paraffins into solid adduct, c. vigorously mixing the mixture of mineral oil solution and urea for a period of time sufficient to form n-paraffin-urea adduct, d. separating from the mixture of step (c) a solids-free solution of dewaxed mineral oil, and e. recovering from said solids-free solution the organic solvent and dewaxed mineral oil having a reduced n-paraffin content.

In a preferred embodiment, the process is conducted continuously, without any difficulties in filtration and at relatively short residence times for the reaction mixture. This may be carried out by pumping the mixture of mineral oil, solvent and urea in a closed loop and continuing the circulation until the solid adducts are formed. If desired, a slip stream of the circulating reaction mixture may be drawn off periodically or continuously and the solids contained therein may be separated by any conventional means, e.g., by filtration or centrifuging, and the liquid parts of said slip stream may be recycled to the reaction mixture. From the separated solids, adduct and excess urea, essentially pure crystalline urea may be easily recovered by conventional techniques, e.g., extraction or decomposition, and this recovered urea may also be recycled to the reaction mixture. If desired the n-paraffins may be recovered from the extract.

The mineral oil distillates which may be dewaxed in this process contain small amounts of n-paraffins. By small amounts we mean distillates containing less than 2 weight percent n-paraffins, particularly less than 1 weight percent. The process is even effective where the feedstock contains less than 0.5 weight percent n-paraffins.

The organic solvent added to the mineral oil distillate feed should not form an adduct with urea, urea should be essentially insoluble in it and it should have a density substantially below the n-paraffin urea adduct. Useful solvents include lower aliphatic hydrocarbons, such as pentane, hexane and heptane; aromatic hydrocarbons, such as, benzene and toluene; lower alcohols, such as methanol and isopropanol; ketones, such as butanone and methylisobutylketone and halogenated hydrocarbons such as, dichloromethane and dichloroethane. Mixtures of these solvents may also be employed. In particular it was found that suitable solvents for performing the improved dewaxing process according to the invention percent of a hydrocarbon having from 5 to 7 carbon atoms such as hexane or, preferably, benzene and from about 5 to 60 volume percent of methylisobutylketone. The mineral oil charge is diluted with 30 to 80 parts by volume, more particularly 40 to 60 parts by volume, of this solvent mixture, per 100 parts by volume of mineral oil distillate but higher concentrations of solvent also are acceptable.

In this process, to effectively remove the small quantity of n-paraffins present, large excesses of the stoichiometric quantity of urea required for adduct formation are required. For adduct formation 3.5 to 4 parts (weight) of urea per part (weight) of n-paraffin are required. In our process up to 20 times or more, preferably up to 10 times the amount required for complete conversion of n-paraffins into solid adduct are used.

This process finds particular utility in dewaxing naphthenic base mineral oil distillates to produce refrigerator oils. Refrigerator oils usually are prepared from isoparaffinic products obtained from a hydrocracking process or preferably from naphthenic base mineral oil distillates. These starting materials already have low pour points, ranging from about minus 30 to minus 50°C. or lower, but nevertheless contain minor amounts of n-paraffins which must be removed therefrom completely or at least to a large extent since they may cause haziness or flocculation (cf., for example, C. Zerbe, "Mineraloele und verwandte Produkte," 2nd edition (1969), Part II, pp. 321–339). These oils may be tested for haziness or flocculation in the so-called Freon flocculation test according to German Standard (DIN) No. 51351 and DIN 51590. A refrigerator oil which is to be employed in refrigerators operated on $CF_2Cl_2$ (Freon 12) should have a Freon cloud point or flock point of at least about minus 55°C. Freon is a registered trademark for a series of halogenated hydrocarbon refrigerants.

In the examples below, three distillates of naphthenic base crude oils having the following properties were dewaxed:

| Distillate No. | 1 | 2 | 3 |
|---|---|---|---|
| Viscosity, SUS | | | |
| at 37.8°C. | 84 | 313 | 515 |
| at 98.8°C. | 37 | 47 | 58 |
| Pour Point,°C. (ASTM-D-97) | −51 | −37 | −32 |
| n-Paraffins, circa weight % | 0.4 | 0.3 | 0.2 |

The following examples demonstrate the process of this invention.

EXAMPLE I

This example demonstrates the dewaxing of low content n-paraffin distillates by conventional urea dewaxing methods.

100 parts by volume of each of the above distillates, distillates No. 1, 2 and 3, were mixed with 1.7 to 3.0 parts by volume of a solvent mixture consisting of isopropanol (33.3 volume percent) and methanol (66.7 volume percent) and 1.3 to 2.1 parts by weight of crystalline urea. The mixture was stirred with a propeller mixer (F1) at 1400 to 2800 revolutions per minute or with a Turrax mixer (T) at 8000 rpm. The initial temperature of the mixture was 25°C. and gradually rose to 40°C. The stirring period was from 6 to 8 hours for the propeller mixer and 10 minutes for the Turrax mixer. At the end of the respective mixing time, stirring was stopped and the reaction mixture was allowed to stand for 7 hours. Table 1 below indicates the Freon cloud points and flock points obtained for the dewaxed distillate.

TABLE 1

| RUN NO. | 1 | 2 | 3 | 4 | 5 | 6 | 7 |
|---|---|---|---|---|---|---|---|
| Distillate No. | 1 | 1 | 1 | 2 | 2 | 3 | 3 |
| Charge Oil, parts (vol.) | 100 | 100 | 100 | 100 | 100 | 100 | 100 |
| Solvent mixt., parts (vol.) | 1.7 | 1.7 | 1.7 | 2.2 | 2.2 | 3.0 | 3.0 |
| Urea, wt. % ** | 1.3 | 1.3 | 1.3 | 1.6 | 1.6 | 2.1 | 2.1 |
| Temperature, °C. | 25–40 | 25–40 | 25–40 | 25–40 | 25–40 | 25–40 | 25–40 |
| Time, hours | 6 | 8 | 10 min* | 6 | 8 | 6 | 8 |
| Type of mixer | Fl | Fl | T | Fl | Fl | Fl | Fl |
| Freon cloud point, °C. | −50 | −65 | −49 | −30 | −47 | −30 | −45 |
| Freon flock point, °C. | −51 | −69 | −56 | −30 | −53 | −30 | −55 |

*formation of an emulsion
**based on charge oil

EXAMPLE II

Each of distillates No. 1, 2 and 3 was mixed with 10 grams of crystalline urea per 100 ml of distillate and with 40 or 95 vol.%, based on the distillate, of methylisobutylketone (MIBK).

In Runs Nos. 8, 10 and 11 a mixture containing 100 ml of distillate was separated from the solids by filtration. The solids then were reacted five more times in Run 8, in Runs 10 and 11 four more times, with 100 ml of fresh distillate and 40 or 95 ml. of solvent. All mixtures were stirred with a Turrax mixer (8000 rpm).

In contrast, in Run No. 9, the whole mixture was circulated through a decanter for 60 min by means of a gear pump having a capacity of 200 l/hr.

Further data and the cloud point and flock point values obtained for the filtrates are shown in Table 2 below:

TABLE 2

| Run No. | 8 | 9 | 10 | 11 |
|---|---|---|---|---|
| Distillate No. | 1 | 1 | 2 | 3 |
| Charge Oil, parts (vol.) | 6×100 | 600 | 5×100 | 5×100 |
| MIBK, parts (vol.) | 6×40 | 240 | 5×95 | 5×95 |
| Crystalline Urea, wt.% * | 1.96 | 1.96 | 2.3 | 2.3 |
| Temperature,°C. | 40 | 30 | 40 | 40 |
| Time, min. | 6×10 | 60 | 5×10 | 5×10 |
| * based on charge oil | | | | |
| Run No. | 8 | 9 | 10 | 11 |
| Type of mixer | T | P* | T | T |
| Freon cloud point, °C. | −65 | −65 | −47 | −45 |
| Freon flock point, °C. | −69 | −70 | −54 | −51 |

*gear pump

In Runs 8, 10 and 11 the Freon cloud points of even the last filtrates were below minus 65°C. (distillate 1) and below minus 45°C. (distillates 2 and 3), respectively.

In Run No. 9 the dispersion of solids in the distillate solution was circulated in the lower portion of a decanter by means of the pump. The suction effected by the pumping caused the solids to settle at the bottom of the decanter so that the overflow at the upper end thereof was practically free of solids.

EXAMPLE III

Run No. 9 of Example II was carried on in continuous operation by continuously introducing fresh distillate solution into the lower portion of the decanting column through which the reaction mixture was being circulated. The run was terminated after the concentration of the urea, initially at 10 parts by weight, had dropped to 2 parts by weight per 100 parts of total distillate charge. The Freon cloud point of the effluent from the decanting column was at minus 64°C.

EXAMPLE IV 100 parts by volume of distillate No. 1 were mixed with 10 parts by weight of crystalline urea and varying amounts of different solvents and stirred with a propeller mixer at 25°C. In two Runs the reaction was carried out in the presence of seed adduct. The results are shown in Table 3 below:

TABLE 3

| Run no. | 12 | 13 | 14 | 15 |
|---|---|---|---|---|
| Seed Adduct | — | — | — | + |
| Charge Oil, parts (vol.) | 100 | 100 | 100 | 100 |
| MIBK, parts (vol.) | 18 | 12 | 18 | 12 |
| Benzene, parts (vol.) | — | 48 | 42 | 28 |
| Toluene, parts (vol.) | 42 | — | — | — |
| Hexane, parts (vol.) | — | — | — | — |
| Freon cloud point,°C. | −58 | 57 | −59 | −62 |
| Freon flock point,°C. | −68 | −65 | −69 | −70 |

| Run No. | 16 | 17 |
|---|---|---|
| Seed Adduct | — | + |
| Charge Oil, parts (vol.) | 100 | 100 |
| MIBK, parts (vol.) | 40 | 40 |
| Benzene, parts (vol.) | — | — |
| Toluene, parts (vol.) | — | — |
| Hexane, parts (vol.) | — | 40 |
| Freon cloud point,°C. | −65 | −61 |

TABLE 3-continued

| Run no. | 12 | 13 | 14 | 15 |
|---|---|---|---|---|
| Freon flock point,°C. | −70 | −69 | | |

According to this invention, employing a large excess amount of the urea actually required for the complete conversion into adducts of the n-paraffin contained in the charge material, and circulating the reaction mixture by pumping, one suceeds, in a surprisingly short time, in freeing the charge material of n-paraffins to such an extent that mineral oil products are obtained which are suitable as refrigerator oils. The process of the invention can be run continuously, without any difficulties in filtration and at relatively short residence times of the reaction mixture.

We claim:

1. In a process for dewaxing liquid mineral oils comprising reacting said liquid mineral oils with urea in the presence of an organic solvent to form solid, n-paraffin-urea adducts, separating said adducts from the solution of the dewaxed mineral oil, decomposing or extracting the separated adducts, recovering and recycling the urea and, optionally, recovering the n-paraffins, the improvement which comprises:

a. diluting a mineral oil containing less than 2 weight percent of a n-paraffins with an organic solvent, said solvent being one which does not form an adduct with urea, in which urea is substantially insoluble and which has a density substantially below that of the n-paraffin-urea adduct, b. combining the mineral oil solution with solid urea, the amount of urea being a multiple of the amount required for the completed conversion of the n-paraffins into n-paraffin-urea adduct, c. vigorously mixing the mixture of mineral oil solution and urea by pumping the mixture of mineral oil solution and urea through a closed loop whereby said mixture is continuously circulated for a period of time sufficient to form n-paraffin-urea adduct, d. separating from the mixture of step (c) a solids-free solution of dewaxed mineral oil, and e. recovering from said solids-free solution the organic solvent and a dewaxed mineral oil product having a reduced n-paraffin content, f. continuously removing a portion of said circulating mixture, g. removing the solids from said portion, h. returning said solids-free portion to said circulating mixture, i. recovering the urea from the separated solids of step (g) by decomposing the adduct in said solids, and j. returning the recovered urea to the circulating mixture.

2. A process according to claim 1 including the following additional step:

k. recovering the n-paraffin from the decomposed adduct of step (i).

3. A process according to claim 1 wherein the mineral oil is a naphthenic base mineral oil having a pour point of at least minus 30°C and a n-paraffin content below about 0.5 weight percent and the dewaxed mineral product having a Freon cloud point (DIN 51351) of at least minus 55°C.

4. A process according to claim 1 wherein the amount of urea is up to 20 times the amount required for the complete conversion of the n-paraffins into n-paraffin-urea adduct.

5. A process according to claim 1 wherein the organic solvent is a mixture of from about 40 to 95 volume percent of a hydrocarbon having 5 to 7 carbon atoms and from about 60 to 5 volume percent of methylisobutylketone and the mineral oil is diluted with 30 to 80 parts by volume of solvent per 100 parts by volume of the mineral oil.

6. A process according to claim 5 wherein the mineral oil is diluted with 40 to 60 parts by volume of the solvent per 100 parts by volume of the mineral oil.

7. A process according to claim 5 wherein the hydrocarbon is hexane.

8. A process according to claim 5 wherein the hydrocarbon is benzene.

* * * * *